US009266167B2

(12) United States Patent
Shaber

(10) Patent No.: US 9,266,167 B2
(45) Date of Patent: Feb. 23, 2016

(54) OXIDE CONTROL SYSTEM FOR A CONTINUOUS CASTING MOLTEN METAL MOLD

(71) Applicant: Wagstaff, Inc., Spokane, WA (US)

(72) Inventor: Craig Shaber, Spokane Valley, WA (US)

(73) Assignee: Wagstaff, Inc., Spokane, WA (US)

( * ) Notice: Subject to any disclaimer, the term of this patent is extended or adjusted under 35 U.S.C. 154(b) by 0 days.

(21) Appl. No.: 14/630,020

(22) Filed: Feb. 24, 2015

(65) Prior Publication Data

US 2015/0239040 A1 Aug. 27, 2015

Related U.S. Application Data

(60) Provisional application No. 61/943,809, filed on Feb. 24, 2014.

(51) Int. Cl.

| | |
|---|---|
| ***B22D 11/10*** | (2006.01) |
| ***B22D 11/119*** | (2006.01) |
| ***B22D 11/14*** | (2006.01) |
| ***B22D 11/18*** | (2006.01) |

(52) U.S. Cl.

CPC ..... *B22D 11/10* (2013.01); *B22D 11/119* (2013.01); *B22D 11/141* (2013.01); *B22D 11/181* (2013.01)

(58) Field of Classification Search

CPC ..... B22D 11/015; B22D 11/10; B22D 11/11; B22D 11/119; B22D 11/141; B22D 11/181

USPC ..... 164/437, 453, 467, 488, 503

See application file for complete search history.

(56) References Cited

U.S. PATENT DOCUMENTS

| | | | | |
|---|---|---|---|---|
| 4,273,180 | A * | 6/1981 | Tertishnikov | B22D 11/015 164/467 |
| 4,715,586 | A | 12/1987 | Schmidt et al. | |
| 4,724,896 | A | 2/1988 | Rose et al. | |
| 5,184,667 | A * | 2/1993 | Carrupt | B22D 11/015 164/467 |
| 2009/0288795 | A1 | 11/2009 | Bischoff et al. | |
| 2010/0252713 | A1 | 10/2010 | Saito | |

* cited by examiner

*Primary Examiner* — Kevin E Yoon

(74) *Attorney, Agent, or Firm* — Wells St. John, PS

(57) ABSTRACT

An oxide control system (apparatus and process) for use in a continuous casting mold for controlling, directing and managing the flow of metal oxides which develop on the molten metal surface within the oxide dam. This invention discloses a new oxide dam which provides predetermined outlets which control and manage the flow of metal oxides to locations within the mold cavity and resulting castpart where oxides are acceptable, yet directing the metal oxides away from locations where the oxides are unacceptable on the resulting castpart.

12 Claims, 5 Drawing Sheets

OXIDE CONTROL SYSTEM FOR A CONTINUOUS CASTING MOLTEN METAL MOLD

CROSS REFERENCE TO RELATED APPLICATION

This application claims priority and the benefit of the filing date of U.S. Provisional Patent Application No. 61/943,809, filed Feb. 24, 2014.

TECHNICAL FIELD

This invention pertains to an oxide control and skimming system for use in a continuous or semi-continuous casting molten metal mold, which may include positional skimming and oxide directional components.

BACKGROUND OF THE INVENTION

Metal ingots, billets and other castparts may be formed by a casting process which utilizes a vertically oriented mold situated above a large casting pit beneath the floor level of the metal casting facility, although this invention may also be utilized in horizontal molds. The lower component of the vertical casting mold is a starting block. When the casting process begins, the starting blocks are in their upward-most position and in the molds. As molten metal is poured into the mold bore or cavity and cooled (typically by water), the starting block is slowly lowered at a pre-determined rate by a hydraulic cylinder or other device. As the starting block is lowered, solidified metal or aluminum emerges from the bottom of the mold and ingots, rounds or billets of various geometries are formed, which may also be referred to herein as castparts.

While the invention applies to the casting of metals in general, including without limitation, aluminum, brass, lead, zinc, magnesium, copper, steel, etc., the examples given and preferred embodiment disclosed may be directed to aluminum, and therefore the term aluminum or molten metal may be used throughout for consistency even though the invention applies more generally to metals.

While there are numerous ways to achieve and configure a vertical casting arrangement, FIG. 1 illustrates one example. In FIG. 1, the vertical casting of aluminum generally occurs beneath the elevation level of the factory floor in a casting pit. Directly beneath the casting pit floor 101*a* is a caisson 103, in which the hydraulic cylinder barrel 102 for the hydraulic cylinder is placed.

As shown in FIG. 1, the components of the lower portion of a typical vertical aluminum casting apparatus, shown within a casting pit 101 and a caisson 103, are a hydraulic cylinder barrel 102, a ram 106, a mounting base housing 105, a platen 107 and a base with starting heads 108 (also referred to as a starting block base), all shown at elevations below the casting facility floor 104.

The mounting base housing 105 is mounted to the floor 101*a* of the casting pit 101, below which is the caisson 103. The caisson 103 is defined by its side walls 103*b* and its floor 103*a*.

A typical mold table assembly 110 is also shown in FIG. 1, which can be tilted as shown by hydraulic cylinder 111 pushing mold table tilt arm 110*a* such that it pivots about point 112 and thereby raises and rotates the main casting frame assembly, as shown in FIG. 1. There are also mold table carriages which allow the mold table assemblies to be moved to and from the casting position above the casting pit.

FIG. 1 further shows the platen 107 and starting block base 108 partially descended into the casting pit 101 with castpart 113 (which may be an ingot or a billet) being partially formed. Castpart 113 is on the starting block base 108, which may include a starting head or bottom block, which usually (but not always) sits on the starting block base 108, all of which is known in the art and need not therefore be shown or described in greater detail. While the term starting block base is used for item 108, it should be noted that the terms bottom block base and starting head base are also used in the industry to refer to item 108.

While the starting block base 108 in FIG. 1 only shows one starting block 108 and pedestal, there are typically several starting blocks mounted on each starting block base, which simultaneously cast billets or ingots, as the starting block base is lowered during the casting process.

When hydraulic fluid is introduced into the hydraulic cylinder at sufficient pressure, the ram 106, and consequently the starting block base 108, are raised to the desired start elevation for the casting process, which is when the starting blocks are within the mold table assembly 110.

The lowering of the starting block base 108 is accomplished by metering the hydraulic fluid from the cylinder at a pre-determined rate, thereby lowering the ram 106 and consequently the starting block base at a pre-determined and controlled rate. The mold is controllably cooled during the process to assist in the solidification of the emerging ingots or billets, typically using water cooling means. Although the use of a hydraulic cylinder is referred to herein, it will be appreciated by those of ordinary skill in the art that there are other mechanisms and ways which may be utilized to lower the platen.

There are numerous mold and casting technologies that fit into mold tables, and no one in particular is required to practice the various embodiments of this invention, since they are known by those of ordinary skill in the art.

The upper side of the typical mold table operatively connects to, or interacts with, the metal distribution system. The typical mold table also operatively connects to the molds which it houses.

When metal is cast using a continuous cast vertical mold, the molten metal is cooled in the mold and continuously emerges from the lower end of the mold as the starting block base is lowered. The emerging billet, ingot or other configuration is intended to be sufficiently solidified such that it maintains its desired profile, In some casting technologies, there may be an air gap between the emerging solidified metal and the permeable ring wall, while in others there may be direct contact. Below that, there is also a mold air cavity between the emerging solidified metal and the lower portion of the mold and related equipment.

Once casting is complete, the castparts, are removed from the bottom block or starting head.

The casting process is initiated by the introduction of molten metal into the mold cavity and the solidification of the molten metal through the mold cavity occurs by the application of a cooling fluid such as water. The cooling fluid is applied around the perimeter of the mold cavity and in the process, causes the walls of the mold cavity to cool. As the mold cavity wall is cooled the molten metal adjacent to the wall generally solidifies and shrinkage occurs around the solidifying surface of the castpart. The shrinkage of the castpart then causes the solidifying castpart to shrink back away from the cooler mold wall, resulting in some re-melting of solidifying surface of the castpart and expansion back to the mold wall. This solidification process occurs and the resulting castpart emerges out of the mold cavity with a solidified outer surface or skin and the inner core of the castpart is still in its molten state. A continuous supply of cooling fluid is applied to the perimeter of the solidifying castpart emerging from the mold cavity.

At or above the entrance or inlet to the mold, molten metal is delivered by the trough distribution system and provided at a location above the mold inlet. It is generally desirable to monitor, control and maintain the molten metal entering the mold cavity to control the quality and safety of the cast. This may require or include a molten metal surface level sensor which senses the exact surface level of the molten metal to optimize its position relative to the mold.

During the molding process for aluminum and various alloys, certain oxides form on the exposed surface of the molten metal during the casting process. It is undesirable to have oxides form on certain primary areas of the exterior surface of the castpart as it can initiate cracking in the castpart or affect the quality of the castpart for downstream manufacturing and rolling operations on that castpart. For example, larger castparts referred to as ingots would be generally rectangular in shape and would have two larger flat surfaces which would be referred to as the rolling surfaces. When a large ingot is rolled, the rolling surfaces are placed to interface with and between large rollers and through repetitious rolling operations a relatively thick ingot is reduced down to a thickness which may for example be used to manufacture aluminum cans.

It is very desirable in producing castparts destined for certain operations such as rolling, that the oxides be minimized or eliminated on certain critical surfaces of the castpart, such as the rolling surfaces. For an ingot destined to be rolled, it is acceptable to have some level of oxides on the end portions of the cross-section of the ingot because those oxides do not have the as much impact on the rolling surface casting cracking or downstream rolling operations. However, if the oxides are allowed to travel to the rolling surface, the castpart quality will be negatively affected.

This has been a well-known problem in the industry for a long time, and in order to prevent the oxides on the surface of the molten metal from traveling to the rolling surfaces or other surfaces where it is important to minimize the oxides, typical prior art devices utilize what are referred to as dams or oxide barriers. These dams or oxide barriers are generally rectangular, elliptical or circular shaped rings which present a barrier that starts below the surface of the molten metal and extends upward above the surface so that the oxides that are forming on the surface cannot travel or flow to a surface of the castpart. In prior art dams, the oxides buildup relatively quickly within the interior of the dams or oxide barriers and thereby create an elevated surface above the actual molten metal level.

While the dams or oxide barriers do reduce or prevent oxide from traveling or flowing to the protected surfaces they build up oxides within the dam or barrier, the molten metal level sensor detects the varying oxide level above the true molten metal level and is not then able to maintain the molten metal surface at the desired or necessary level relative to the mold to optimize the casting. If for example, the oxide buildup is two to four millimeters above the surface of the molten metal the sensor control system consequently maintains the molten metal level two to four millimeters below its intended location. Unintended and negative consequences may occur. These consequences may include lower quality casting or a condition referred to in the industry as a bleed out condition which may result in molten metal escaping into the casting area and casting pit.

While in some prior art the molten metal surface level sensor has been moved to a location to sense metal outside of the oxide barrier or dam, this is not as desirable for multiple reasons, such as incomplete oxide retention, and especially in certain applications.

It is therefore desirable and an object of this invention to more effectively and accurately control the level of molten metal in continuous cast molds by controlling, managing and routing the oxides forming on the surface of the molten metal, while maintaining sufficiently accurate molten metal surface area sensing and monitoring.

It is therefore an object of some embodiments of this invention to provide a system for more effectively and accurately controlling the level of molten metal in continuous cast molds by controlling, managing and routing the oxides forming on the surface of the molten metal.

Other objects, features, and advantages of this invention will appear from the specification, claims, and accompanying drawings which form a part hereof. In carrying out the objects of this invention, it is to be understood that its essential features are susceptible to change in design and structural arrangement, arrangement with only one practical and preferred embodiment being illustrated in the accompanying drawings, as required.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

It is to be understood that this invention can be utilized in connection with various types of metal pour technologies and configurations. It is further to be understood that this invention may be used on horizontal or vertical casting devices.

A mold or mold framework which may be utilized in embodiments of this invention therefore must be able to receive molten metal from a source of molten metal, whatever the particular source type is. The mold cavities in the mold must therefore be oriented in fluid or mold metal receiving position relative to the source of molten metal.

It will also be appreciated by those of ordinary skill in the art that embodiments of this oxide control system may and will be combined with existing systems and/or retrofit to existing operating casting systems, all within the scope of this invention.

Figure 1:
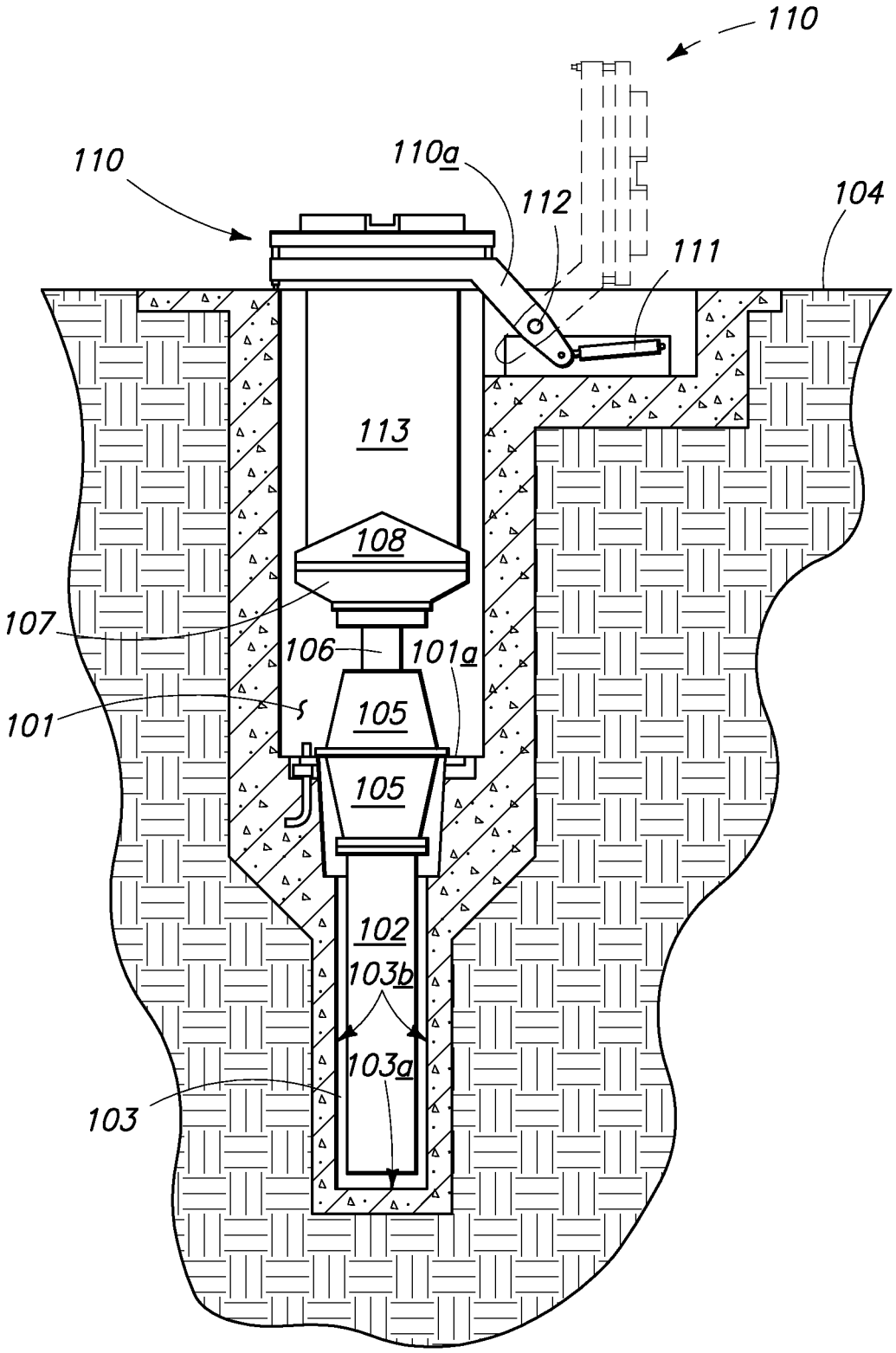
FIG. 1 is an elevation view of a prior art vertical casting pit, caisson and metal casting apparatus.

FIG. 1 is described above in the Background of the Invention section, and will not therefore be repeated here.

Figure 2:
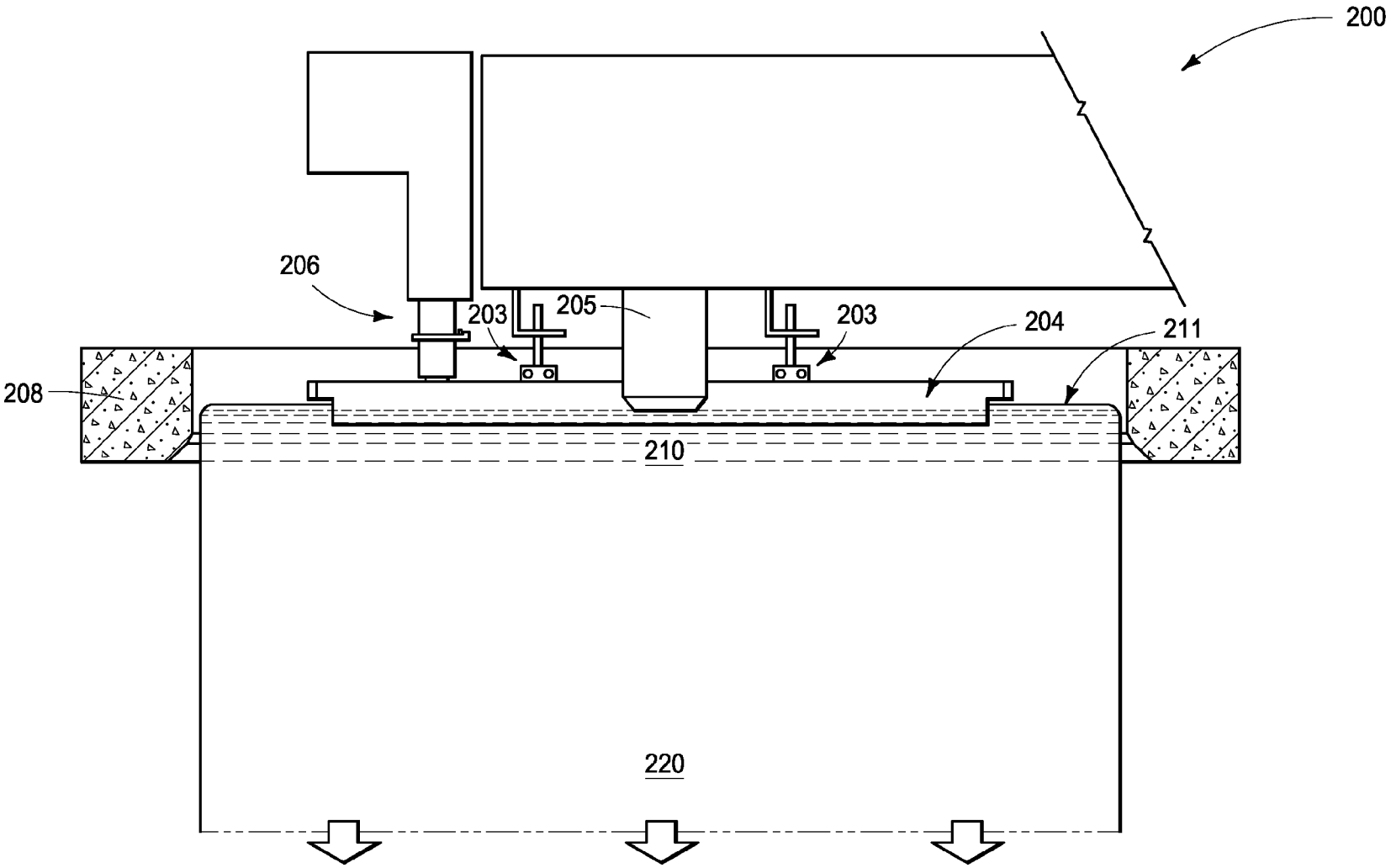
FIG. 2 is an elevation partial cross-sectional view of a vertical continuous casting mold 208, with a molten metal distribution system 205, a molten metal level sensor 206, a castpart being formed 220, and one example of an embodiment of an oxide dam 204 as contemplated by this invention.

FIG. 2 is an elevation partial cross-sectional view of a vertical continuous casting mold system 200, with a molten metal distribution system including molten metal trough, metal delivery conduit or spout 205, a molten metal level sensor 206, a castpart 220 being formed, mold wall 208, oxide barrier 204 oxide barrier brackets 203 for attaching to and positioning oxide barrier 204 relative to the top surface 211 of the molten metal 210 within the mold 208. It should be noted that oxide barrier 204 may be rigidly mounted relative to the molten metal or allowed to float with the molten metal to maintain its position at various metal levels inside the mold.

Figure 3:
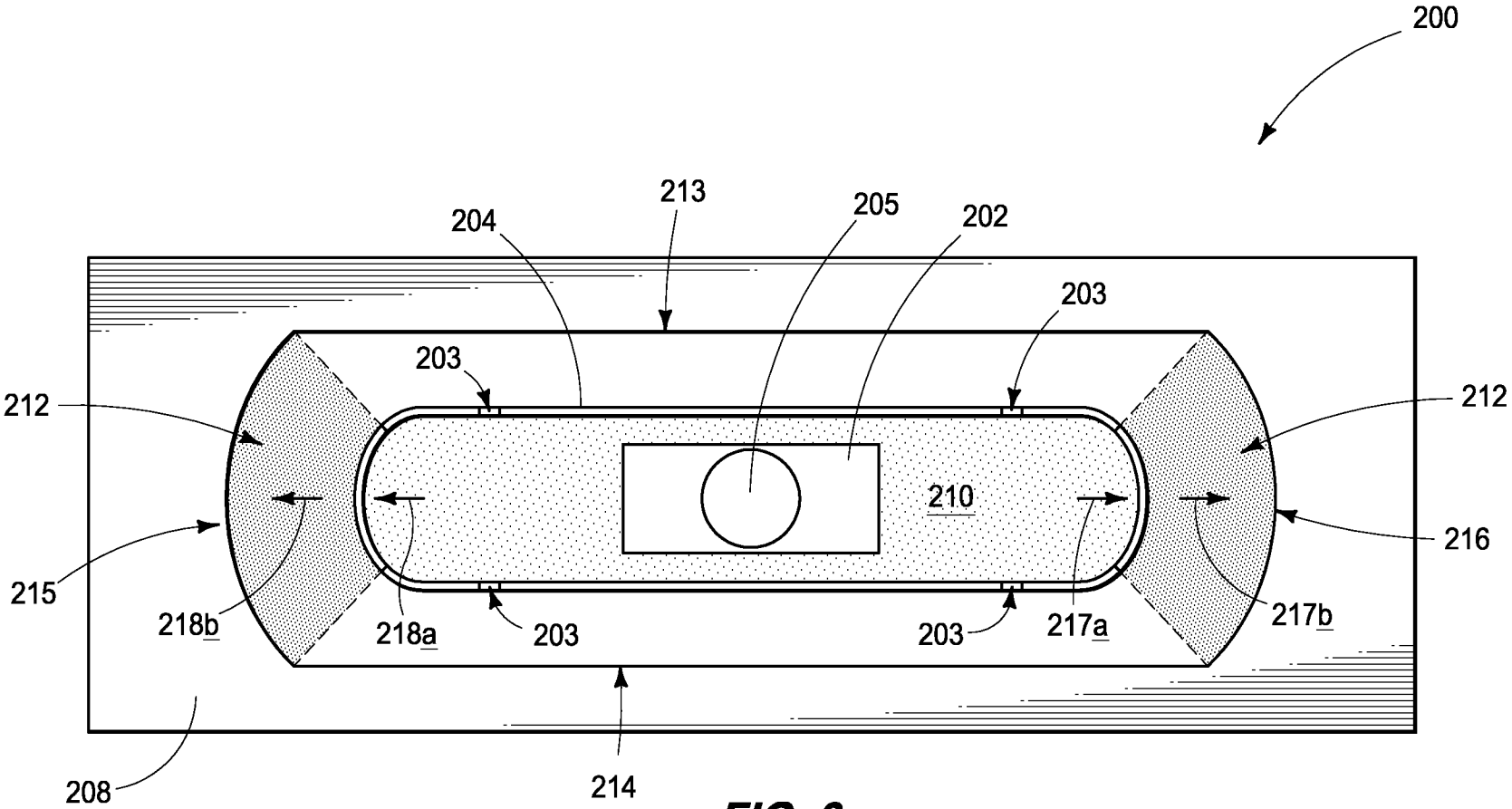
FIG. 3 is a top view of one example of an embodiment of an oxide dam 214 as contemplated by this invention within a mold.

FIG. 3 is a top view of one example of an embodiment of an oxide barrier 204 as contemplated by this invention within a mold 208, illustrating molten metal distribution spout 205, distribution bag 202. FIG. 3 further illustrates molten metal oxide 210 within the boundaries of oxide barrier 204, oxide barrier adapters 203 or points of attachment, and molten metal oxide 212 outside the boundaries of oxide barrier 204.

FIG. 3 illustrates a mold for casting a generally rectangular castpart, showing flat sides 213 and 214, which may also be referred to as the rolling surfaces because those are the surfaces that would be placed into a rolling mill and interact with rollers. The molten metal oxide 210 on the surface of molten metal within the oxide barrier 204 and arrows 217*a* and 218*a* illustrate the controlled or directed movement of surface molten metal oxides toward the ends of the oxide barrier 204 (as compared to the rolling or flat surfaces). Arrows 217*b* and 218*b* illustrate how the oxide barrier not only directs the oxides on the surface of the molten metal toward the ends, but provides in this embodiment an opening or conduit through which the molten metal with oxides can flow to be directed to the desired area, i.e. the first end 215 and second end 216 of the castpart being cast. The oxide barrier illustrated in FIG. 3, is shown more fully in FIG. 5.

Figure 4:
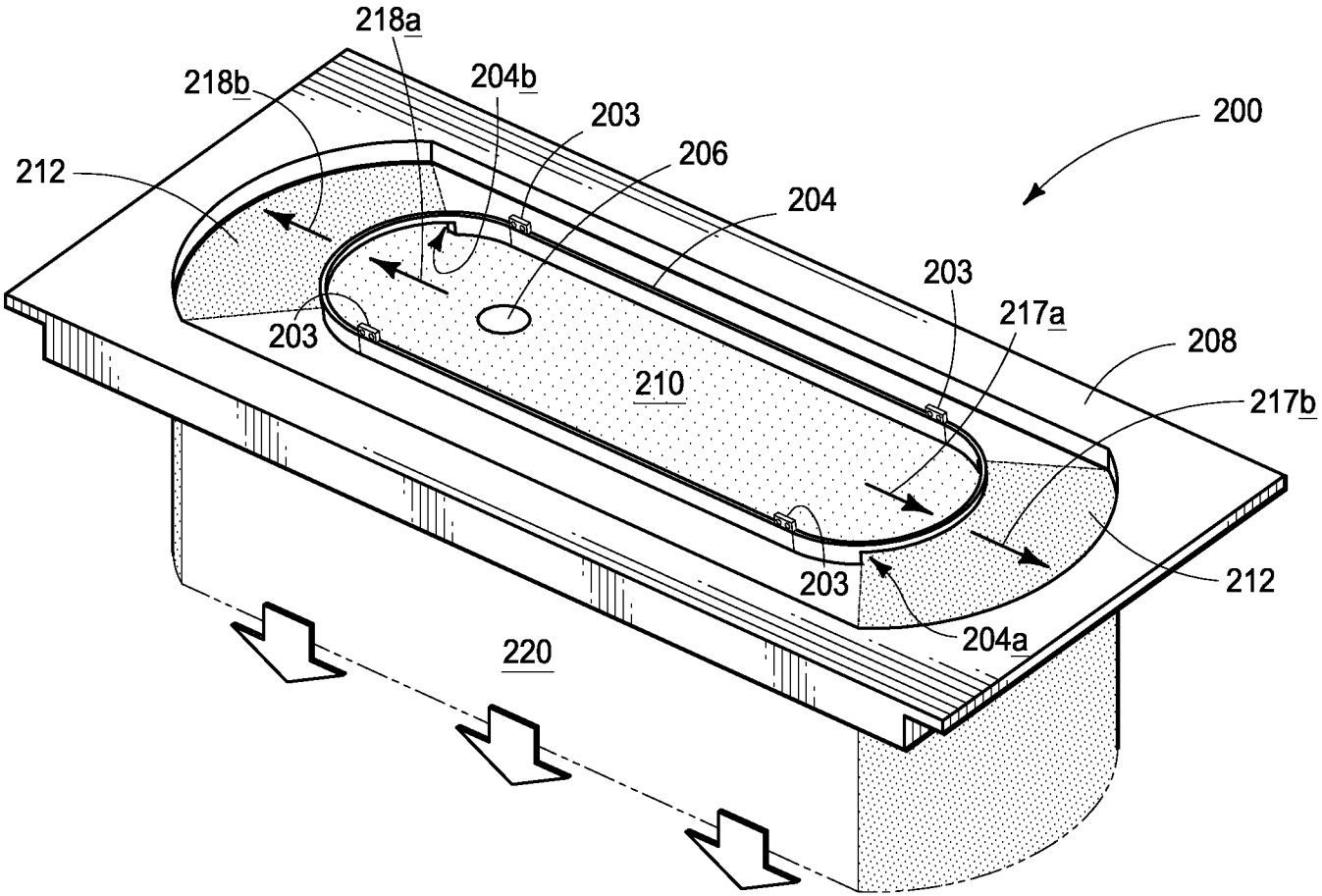
FIG. 4 is a perspective view of the example of the embodiment of this invention illustrated in FIG. 3.

FIG. 4 is a perspective view of the example of the embodiment of this invention illustrated in FIG. 3, illustrating casting mold system 200, mold 208, castpart 220, oxide barrier 204 with adapters 203, and molten metal oxide surface 210. FIG. 4 further illustrates the oxide barrier outlets or exits 204*a* and 204*b*, through which the oxides on the molten metal within the oxide barrier flow to the end portions of the castpart 220 instead of to the flat or rolling surfaces.

FIG. 4 further illustrates with arrows 217*a* and 218*a* how the oxide barrier controls or directs the movement of surface molten metal with oxides toward the ends of the oxide barrier 204 (as compared to the rolling or flat surfaces). Arrows 217*b* and 218*b* illustrate how the oxide barrier not only directs the oxides on the surface of the molten metal toward the ends, but provides in this embodiment an opening or conduit through which the molten metal with oxides can flow to be directed to the desired area, i.e. the ends of the castpart being cast.

It will be appreciated by those in the art that while it may be preferred to route or direct the oxides to both the first end 215 and a second end 216 (shown in FIG. 3) of the castpart being cast, this invention also contemplates other configurations to improve the cast, such as only directing the oxides to the first end 215 for example.

Figure 5:
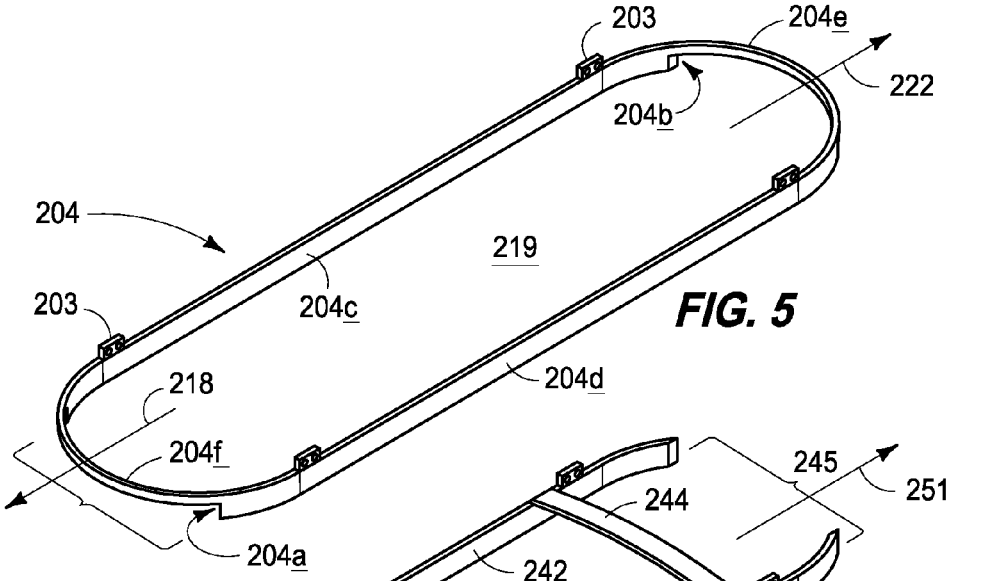
FIG. 5 is a perspective view of one example of an embodiment of an oxide dam that may be utilized in practicing aspects of this invention.

FIG. 5 is a perspective view of one example of an embodiment of an oxide dam 204 that may be utilized in practicing aspects of this invention, illustrating the oxide dam 204, the interior 219 of the oxide dam 204, first side 204*c* and second side 204*d*, first end 204*f* and second end 204*e*, adapters 203 for attaching to and positioning the oxide dam 204 relative to the desired molten metal surface level. In order to controllably route the oxides that are forming on the surface of the molten metal within the interior 219 of the oxide dam 204, two dam outlets are provided in this embodiment at the ends 204*e* & 204*f* of the oxide dam 204. Item 204*a* reflects that there is a partial upper portion of the dam at the end 204*f* so that when the oxide dam 204 is maintained at the appropriate level, oxides may flow under the upper portion of the ends of the oxide dam 204, as reflected by arrows 218 and 222. FIG. 5 further illustrates how there may be a reduction in the cross-sectional area of the interior 219 of the oxide dam 204 to provide better control of the flow and direction of flow of the oxides through the oxide outlets 204*a* & 204*b* in the oxide dam 204.

Figure 6:
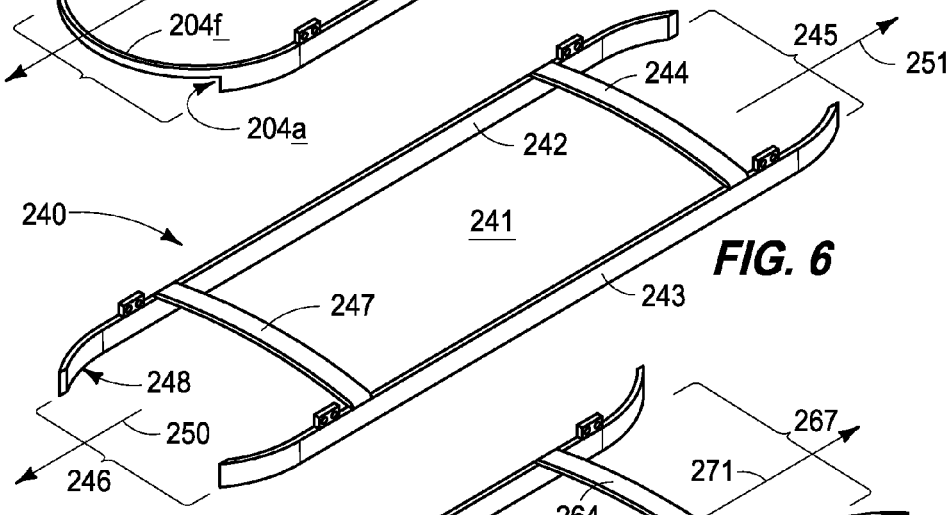
FIG. 6 is a perspective view of another example of an embodiment of an oxide dam that may be utilized in practicing aspects of this invention.

FIG. 6 is a perspective view of another example of an embodiment of an oxide dam 240 that may be utilized in practicing aspects of this invention, illustrating an oxide dam framework comprised of first dam side 242, second dam side 243, dam interior 241, connecting framework members 244 and 247 each attached to first dam side 242 and second dam side 243 to provide the remaining portion of the structure in this embodiment. The example of the embodiment of the oxide dam 240 illustrated in FIG. 6 shows first end outlet 245 and second end outlet 246, with arrows 250 & 251 representing the controlled and directed flow of oxides to the ends of what will be the castpart. Item 248 shows an arcuate portion of first dam side 242 which may be utilized on any one or more ends of the first and second dam sides 242 & 243 to help control and direct the flow of oxides. First dam side 242 and second dam side 243 will be positioned such that the molten metal level falls within the dams and prevents the flow of oxides to the larger rolling surfaces.

Figure 7:
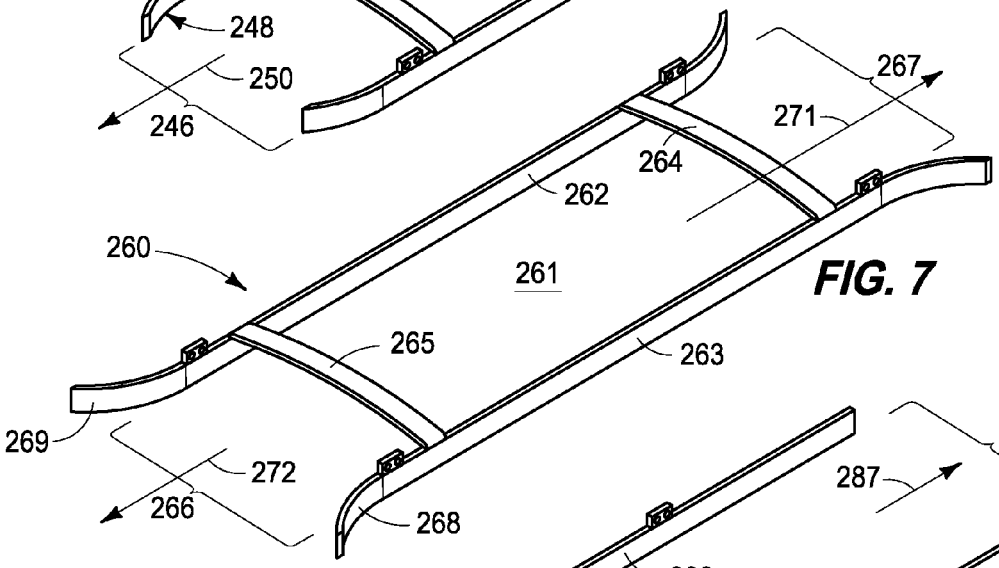
FIG. 7 is a perspective view of another example of an embodiment of an oxide dam that may be utilized in practicing aspects of this invention.

FIG. 7 is a perspective view of another example of an embodiment of an oxide dam 260 that may be utilized in practicing aspects of this invention, illustrating first dam side 262, second dam side 263, dam interior 261, dam cross supports 264 & 265. FIG. 7 further shows first dam outlet 266 and second dam outlet 267, with arrows 271 and 272 indicating the controlled and directed flow of molten metal and oxides toward the end portions of the mold and resulting castpart. In FIG. 7, the arcuate ends of the first dam section 262 and the second dam section 263 are outwardly arcuate as reflected by the end portions 269 & 268 of first dam side 262 and second dam side 263 respectively, to provide a desired controlled and directed flow of oxides to the end portions of the mold and resulting castpart.

Figure 8:
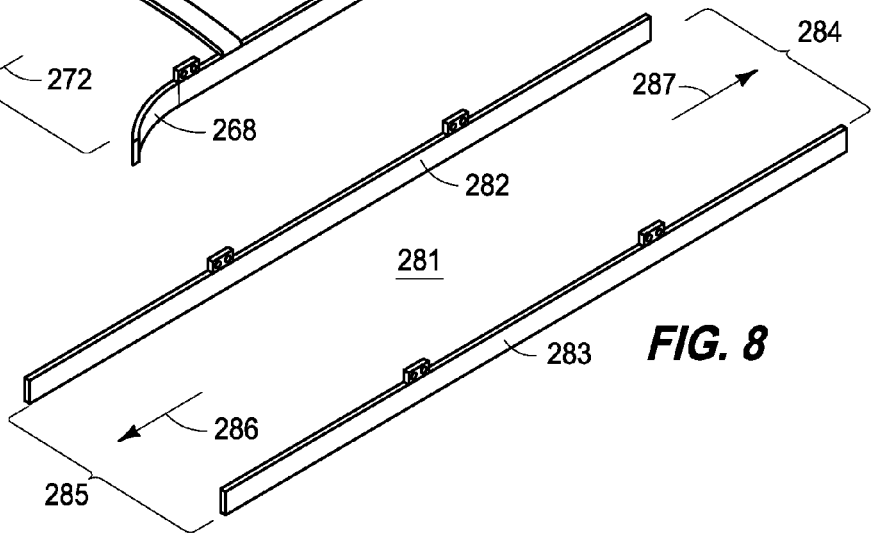
FIG. 8 is a perspective view of another example of an embodiment of an oxide dam that may be utilized in practicing aspects of this invention.

FIG. 8 is a perspective view of another example of an embodiment of an oxide dam 280 that may be utilized in practicing aspects of this invention, illustrating first dam side 282, second dam side 283, dam interior 281, first dam outlet 284 and second dam outlet 285 at the end portions of the dam 280, with arrows 286 & 287 representing the controlled flow of molten metal with oxides directed toward the end portions of the mold and resulting castpart.

This invention addresses a long-standing and known issue in continuous casting, and that is controlling the flow of the metal oxides so that they do not end up on certain surfaces of the resulting castpart. The process of providing a controlled and directed movement of the oxides improves the process because the larger oxide barriers can be used with metal level sensing equipment without the problem of oxides building up and interfering with the sensing of the molten metal level within the dam which has been occurring in the industry.

Once the molten metal is provided to the mold from the distribution trough, it will build up until it reaches the desired casting level. The molten metal sensor will then sense and monitor the molten metal level more precisely because the oxides will not be allowed to build up sufficient height to give false readings of the molten metal level and create negative effects in the casting process. Once the desired molten metal level is reached, building oxides are provided one or more outlets and directed toward the locations where it is acceptable to allow oxides to occur on the surface of the resulting castpart, but more importantly directed away from those surfaces where it is undesirable to allow oxides on the surface of the resulting castpart.

As will be appreciated by those of reasonable skill in the art, there are numerous embodiments to this invention, and variations of elements and components which may be used, all within the scope of this invention. In one embodiment for example a continuous casting mold oxide control process comprising: providing a continuous casting mold with a mold cavity configured to produce a castpart; providing an oxide dam positioned relative to the mold cavity to contain oxides developing on the surface of molten metal provided to the mold, the oxide dam including a dam interior; providing one or more oxide outlets from the dam interior configured to direct the oxides developing on the surface of the molten metal within the oxide dam interior to a pre-determined location within the mold cavity; introducing molten metal into the mold cavity until the desired metal level is sensed by the molten metal level sensor; providing the controlled oxide dam outlet at the surface of the molten metal to direct the oxides forming within the oxide dam interior to flow outside the oxide dam to a pre-determined location within the mold cavity.

Further embodiments to those in the preceding paragraph include a continuous casting mold oxide control process: further wherein the oxide dam is fixed; further wherein the oxide dam is partially submerged and floating on the molten metal surface; further wherein the oxide redirection is for improved surface characteristics of a castpart; further wherein oxide is directed away from the metal sensing device; further wherein oxide is directed away from the rolling surfaces of the castpart; and/or further wherein oxide is directed toward a location corresponding to at least one castpart end.

In another embodiment, an oxide dam control apparatus is provided for use in a continuous casting mold to generate a castpart with two castpart rolling surfaces and two castpart end surfaces, the apparatus comprising: a first skim dam side and an opposing second skim dam side, configured for placement at or about the molten metal surface at a mold inlet in a continuous casting mold; the first skim dam side and second skim dam side being held generally aligned with sides of the mold representing the castpart rolling surfaces; and a first oxide directing skim damn outlet generally corresponding to a first end of the castpart, and configured to direct oxides on the molten metal surface toward a pre-determined location.

Further embodiments to those in the preceding paragraph include an oxide control apparatus: further wherein the first skim dam side and second skim dam side are held generally aligned with sides of the mold representing the castpart rolling surfaces by cross support framework; further comprising a second oxide directing skim damn outlet generally corresponding to a second end of the castpart, and configured to direct oxides on the molten metal surface toward the second end of the castpart; further wherein the predetermined location is at the first end of the castpart being cast; and/or further wherein the predetermined location is also at the second end of the castpart being cast.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A continuous casting mold oxide control process comprising:

providing a continuous casting mold with a mold cavity configured to produce a castpart;

providing an oxide dam positioned relative to the mold cavity to contain oxides developing on a surface of molten metal provided to the mold, the oxide dam including a dam interior;

providing one or more oxide outlets from the dam interior configured to direct the oxides developing on the surface of the molten metal within the oxide dam interior to a pre-determined location within the mold cavity;

introducing molten metal into the mold cavity until the desired metal level is sensed by a molten metal level sensor;

providing the controlled oxide dam outlet at the surface of the molten metal to direct the oxides forming within the oxide dam interior to flow outside the oxide dam to the pre-determined location within the mold cavity.

2. A continuous casting mold oxide control process as recited in claim 1, and further wherein the oxide dam is fixed.

3. A continuous casting mold oxide control process as recited in claim 1, and further wherein the oxide dam is partially submerged and floating on the molten metal surface.

4. A continuous casting mold oxide control process as recited in claim 1, and further wherein the oxide redirection is for improved surface characteristics of a castpart.

5. A continuous casting mold oxide control process as recited in claim 1, and further wherein the oxide is directed away from the molten metal level sensor.

6. A continuous casting mold oxide control process as recited in claim 1, and further wherein the oxide is directed away from rolling surfaces of the castpart.

7. A continuous casting mold oxide control process as recited in claim 1, and further wherein the oxide is directed toward a location corresponding to at least one castpart end.

8. An oxide dam control apparatus for use in a continuous casting mold to generate a castpart with two castpart rolling surfaces and two castpart end surfaces, the apparatus comprising:

a first skim dam side and an opposing second skim dam side, configured for placement at or about a molten metal surface at a mold inlet in a continuous casting mold;

the first skim dam side and second skim dam side being held generally aligned with sides of the mold representing the castpart rolling surfaces; and a first oxide directing skim damn outlet generally corresponding to a first end of the castpart, and configured to direct oxides on the molten metal surface toward a predetermined location.

9. An oxide control apparatus as recited in claim 8, and further wherein the first skim dam side and second skim dam side are held generally aligned with sides of the mold representing the castpart rolling surfaces by cross support framework.

10. An oxide control apparatus as recited in claim 8, and further comprising a second oxide directing skim damn outlet generally corresponding to a second end of the castpart, and configured to direct the oxides on the molten metal surface toward the second end of the castpart.

11. An oxide control apparatus as recited in claim 8 and wherein the predetermined location is at the first end of the castpart being cast.

12. An oxide control apparatus as recited in claim 8 and wherein the predetermined location is also at the second end of the castpart being cast.

* * * * *